United States Patent [19]

Wiebesiek

[11] 4,437,247

[45] Mar. 20, 1984

[54] APPARATUS FOR FEEDING LAUNDRY TO AN IRONING MACHINE

[75] Inventor: Wilhelm Wiebesiek, Vlotho, Fed. Rep. of Germany

[73] Assignee: Herbert Kannegiesser GmbH & Co., Voltho, Fed. Rep. of Germany

[21] Appl. No.: 372,350

[22] Filed: Apr. 27, 1982

[30] Foreign Application Priority Data

May 16, 1981 [DE] Fed. Rep. of Germany ..... 3119600

[51] Int. Cl.[3] ..... D06F 67/04

[52] U.S. Cl. ..... 38/143

[58] Field of Search ..... 38/12, 7, 143; 271/198, 271/85

[56] References Cited

U.S. PATENT DOCUMENTS 3,604,132 9/1971 Thompson ..... 38/143

3,791,057 2/1974 Hall ..... 38/143

4,106,227 8/1978 Allen et al. ..... 38/143

FOREIGN PATENT DOCUMENTS 2258698 7/1974 Fed. Rep. of Germany ..... 38/143

*Primary Examiner*—Werner H. Schroeder

*Assistant Examiner*—Andrew M. Falik

*Attorney, Agent, or Firm*—Sughrue, Mion, Zinn, Macpeak, and Seas

[57] ABSTRACT

Apparatus for feeding laundry articles to an ironing machine, wherein the laundry articles, suspended on two grippers are conveyed, starting from an operating station, to a position centrally in front of the loading position of a feed conveyor leading to the ironing machine. The grippers are disposed on a rope drive, which is driven by means of a geared pole-changing motor with the interposition of a chain drive. The rear gripper is towed by the leading gripper via the laundry article, while at the same time pulling the latter taut.

12 Claims, 8 Drawing Figures

APPARATUS FOR FEEDING LAUNDRY TO AN IRONING MACHINE

The invention relates to an apparatus for feeding laundry articles to an ironing machine or the like, wherein the laundry articles are suspended on two grippers of a conveyor device disposed transversely in front of and offset in height in relation to a feed conveyor leading to the ironing machine and, starting from an operating station situated at the side of the working width of the feed conveyor, are conveyed by the conveyor device for a position centrally in front of the loading position of the feed conveyor, and wherein the two grippers of the conveyor device are disposed on a rope drive capable of controlled driving and can be moved in such a manner that the leading gripper (in the conveying direction) pulls the rear gripper in tow behind it via the laundry article, while at the same time pulling the latter taut.

In one known apparatus (Company leaflet: KANNEGIESSER Multifeed High-Power Feed Machine, Model "C", 5/80 edition) the two grippers are driven by means of a complicated rope drive provided with two wire ropes which are guided over a multiplicity of guide rollers and which are moved in turn by means of pneumatic power cylinders. This is a modification of the drive and control system described in DE-AS No. 2,539,957, with a separate drive for each gripper and coupling of the two drives in the course of the feeding, pulling taut, and centering of the laundry article relative to the feed conveyor. This system is thus not particularly suitable for the towing process previously mentioned, in which the leading gripper pulls the rear gripper in tow behind it via the laundry article, while at the same time pulling the latter taut, and brings the article centrally to the feed conveyor. Moreover, because of the multiplicity of guide rollers and rope deflections the modified system applied is liable to breakdown.

The object of the invention is to improve the gripper drive and control system of the apparatus of the type first mentioned above, both as regards functioning and as regards liability to breakdown.

Through the construction, according to the invention, of the gripper drive and control system, a substantial improvement is achieved both with regard to functioning and with regard to liability to breakdown. The functional requirements of the towing process have been taken into account in an optimum manner. The movements of the grippers are made with due consideration to the stressing permissible for a laundry article, but in such a manner that the throughput of the apparatus can be high. Moreover, only relatively few rope guide rollers and only one relatively short wire rope are required, while pneumatic power cylinders are completely eliminated. Liability to breakdown is thus slight.

Advantageous embodiments and further developments of the gripper drive and control system make it possible for the torque of the geared motor to be adapted to various circumstances in the feeding of different types of laundry articles, this preferably being done simultaneously with the start command for the towing drive or the switching-on of the geared motor. In this case, therefore, the switches previously mentioned not only give the start command but also determine the torque suitable for the laundry article. Other features make it possible for the moment of time when the geared motor should be shifted down to its low speed-in the course of the towing conveying-to be determined with great reliability and always in the correct position, namely at a predetermined distance before the centering of the laundry article. Another feature is the mechanism for centering the article. Through other features particularly functionally advantageous mounting of the rear gripper, which has to be moved by towing, is possible. Additional features permit particularly functionally advantageous return of the two grippers to their starting position.

One embodiment of the apparatus of the invention is illustrated diagrammatically by way of example in the drawings, in which.

Figure 3:
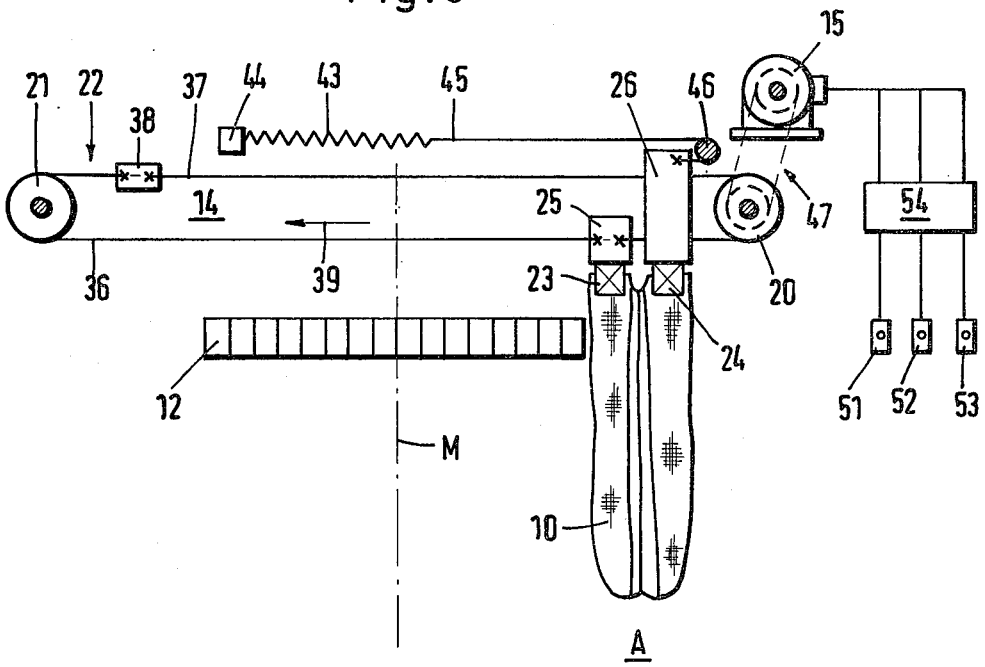
FIGS. 3 to 6 show a basic representation of the cycle of operations in the conveying of the laundry article from the operating station to the taut central position, individual devices and parts being shown on a larger scale than in FIGS. 1 and 2 and in some cases being different from those shown therein.
Figure 4:
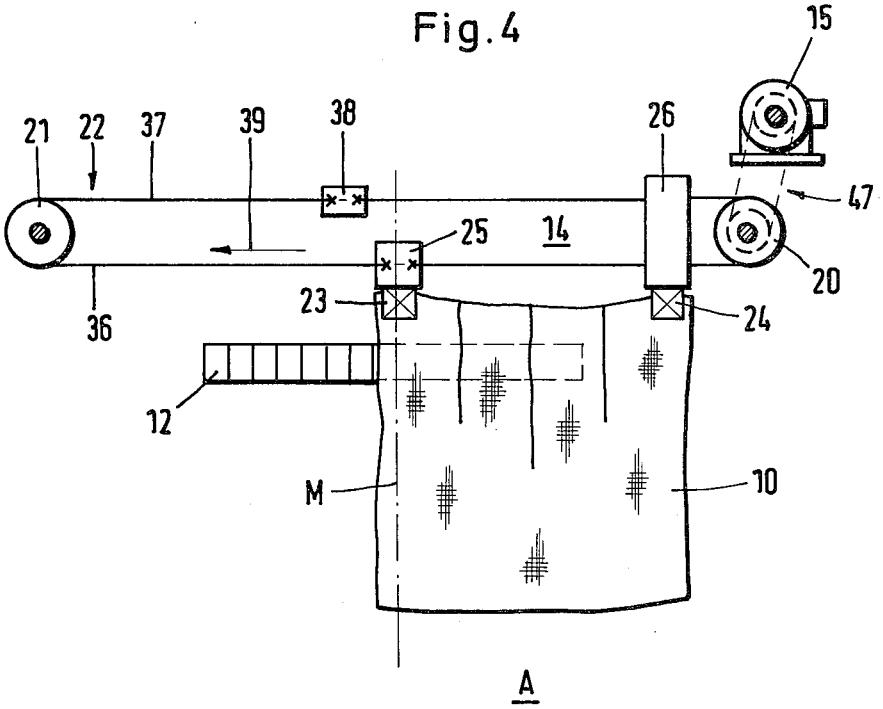

The apparatus shown in the drawings consists firstly of the machine frame 11. Between the side walls of the machine frame 11, which are spaced apart, the feed conveyor 12, together with the presser roller 13, the rope drive 14, the guide rail 42, and the transfer device 55 are disposed and mounted on the side walls in an operationally appropriate manner as known per se. The feed conveyor 12 consists of the guide rollers 16,17 and the belt 18 guided around them. The feed conveyor 12 is continuously driven in the direction of the arrow 19, in a manner known per se, by means of a drive device (not shown). The presser roller 13 is freely rotatable and mounted in a fixed position. The rope drive 14 consists essentially of the driving and guide rollers 20,21 respectively and of the wire rope 22 guided around them, as can be seen in FIGS. 3 to 8. The rope drive 14 is driven by means of the geared pole-changing motor 15, with the interposition of the chain drive 47 comprising the sprockets 48,49 and the chain 50. The grippers 23, 24 are mounted on the wire rope 22 with the interposition of so-called carriages 25,26. Of the two carriages 25,26, at least the carriage 26 of the rear gripper 24 is mounted by means of runners 40,41 for travel in the guide rail 42. The guide rollers 27 to 32 are mounted by means of journals 33, 34, 35 on the carriage 26 of the rear gripper 24. The two strands 36,37 of the rope drive 14 are guided around these guide rollers 27 to 32 in the manner shown in FIGS. 7 and 8. This guidance has the consequence that the carriage 26 and thus the rear gripper 24, which is movable by towing (arrow 39), are mounted between the forwardly moving strand 36 and the rearwardly moving strand 37 of the rope drive 14 in such a manner as not to be driven by friction. If the guiding of the strand 36 is changed so that it is no longer guided around the central guide roller 31, but passes over it (as in the case of the guide rollers 30,32), the carriage 26 and thus the rear gripper 24 will be driven slightly backwards in relation to the towing direction (arrow 39) when the front gripper 23 is driven in the towing direction. This has the effect that the rear gripper 24 is moved in the towing direction (arrow 39) only when a determined tension exists, overcoming the previously mentioned friction in the opposite direction. In addition, as can be seen in FIG. 3, a tension spring 43 and a draw rope 45 are provided for returning the rear gripper 24 from its taut position (FIG. 6) to its starting position in the operating station "A" (FIG. 3). The draw rope 45 is disposed in line with the tension spring 43 and is guided over a guide roller 46. The rear end of the tension spring 43 is fastened to a mounting 44 disposed on the guide rail 42, while the front end of the draw rope 45 is fastened to the carriage 26 of the rear gripper 24. The return movement of the front gripper 23 is made by reversing the direction of rotation of the geared pole-changing motor 15.

Figure 6:
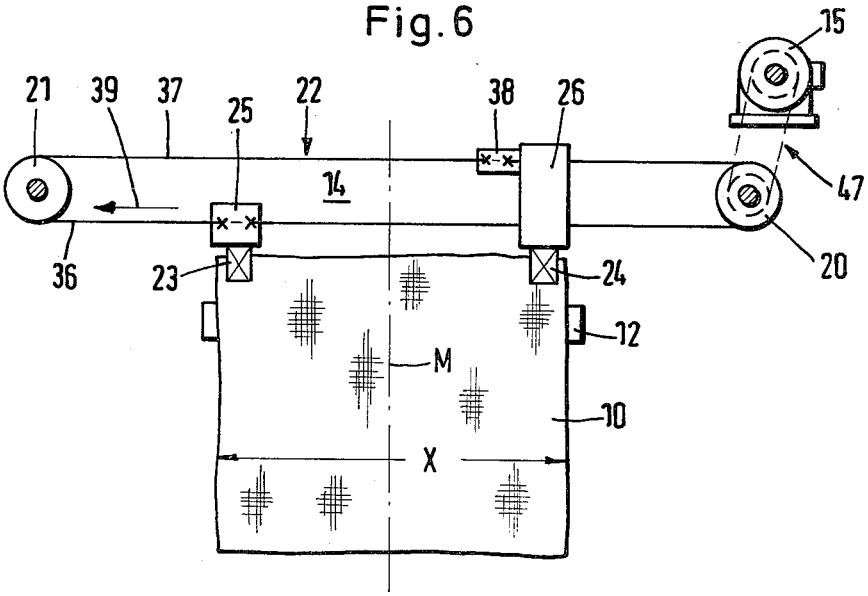
Figure 7:
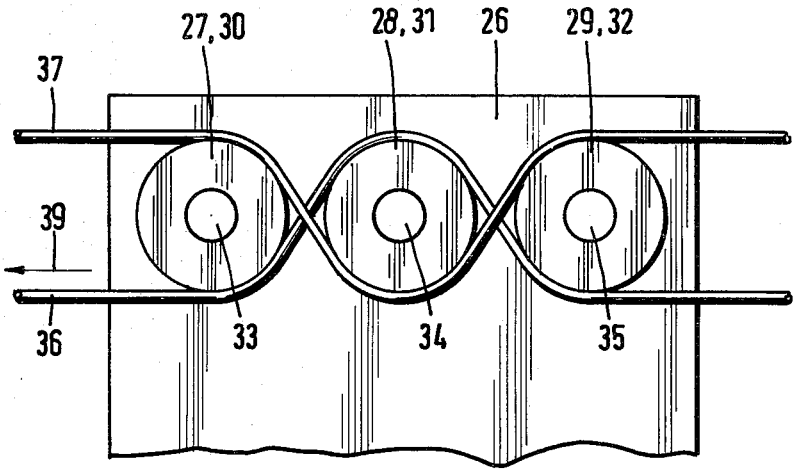
FIG. 7 is an elevation of the mounting of the rear gripper or gripper carriage on the two strands of the rope drive, shown in mirror-image form in relation to FIGS. 3 to 7.
Figure 8:
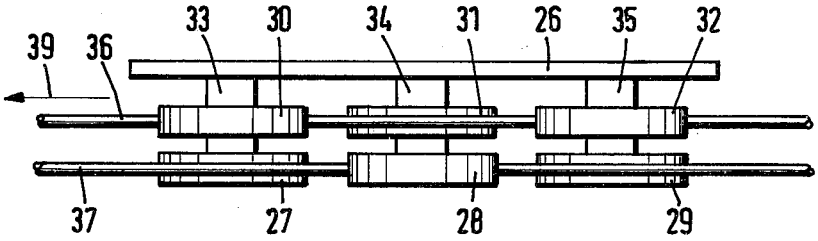
FIG. 8 is a plan view of FIG. 7.

For the control of the geared pole-changing motor 15, three switches 51, 52, 53 are provided in the operating station "A" for the purpose of switching on the geared motor 15 at its high speed, while at the same time determining the torque required in the taut or central position of the grippers 23, 24 having due regard to the nature of the laundry article 10. Each of the three switches 51, 52, 53, which are of different colors or correspondingly underlaid, enables the geared pole-changing motor 15 to be operated at a different voltage, namely at 190, 240, or 380 volts, with the aid of the three-phase current transformer 54. The torque of the geared motor 15 is adjusted in accordance with this voltage setting. The lowest torque is for laundry articles 10 which tolerate only a relatively low tensioning or tautening force, such as for example laundry articles which are already fragile or torn. The medium torque is for laundry articles of medium size and medium weight, for example bed sheets. The high torque is for large and heavy laundry articles, for example bed covers. The moment of time for changing down the geared motor 15 in the course of the towing movement, in order to engage its low speed, is determined by means of a digital electronic system (not shown) comprising a pulse or slot generator for producing a counting frequency as a function of the length "X" of the laundry article 10 (FIG. 6). Measurement and control processes of this type are known per se. In order to fix the central position M, a stop 38 is disposed on the strand 37 of the rope drive 14. The stop 38 is moved oppositely to the towing direction (arrow 39) and runs against the carriage 26 of the rear gripper 24 (FIG. 6). The moment in time when the geared motor 15 is changed down to a lower speed in the course of the return (begun at high speed) of the front gripper 23 to its starting position is determined as a function of time by means of a timer (not shown). These control devices and features are components of the overall electric control device (not shown) of the apparatus, this control device also including means for controlling the transfer device 55 described below.

The transfer device 55 consists essentially of a striker rod 56 mounted in a holder 57. The holder 57 is in turn mounted in guides (not shown), which are disposed on the side walls of the machine frame 11, for movement in the direction of the arrow 60 and back. The holder 57 can be moved in this manner, together with the striker rod 56, by means of the power cylinder 58. The power cylinder 58 is pivotally mounted on the cross-bearer 59 by its rear end.

In FIGS. 3 to 6 the center of the apparatus is designated "M". The feed conveyor 12 is disposed symmetrically thereto. The laundry article 10 is therefore centered in relation to this center.

Figure 1:
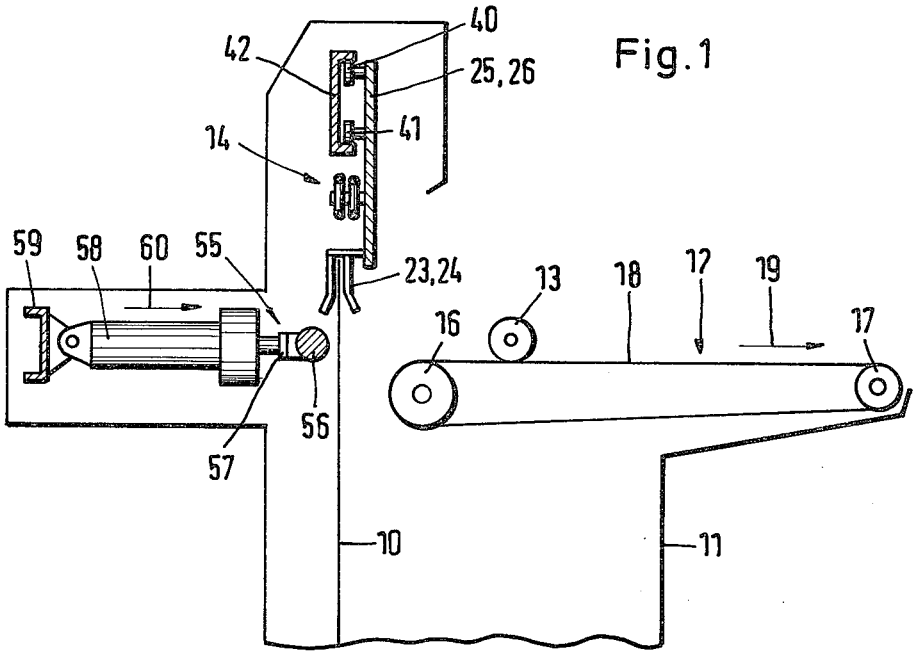
FIG. 1 is a longitudinal section through the apparatus.
Figure 5:
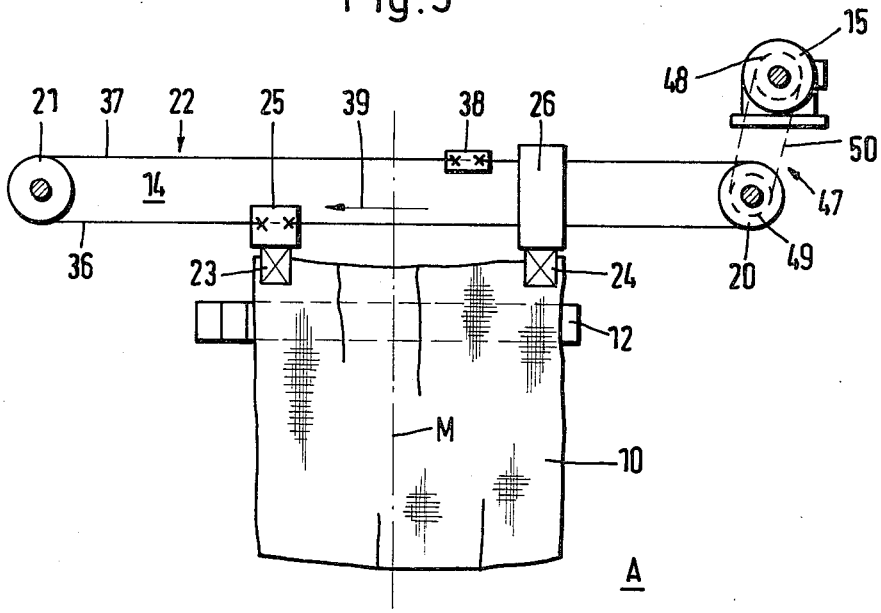

The mode of operation of the apparatus is as follows: The operator (not shown) standing in the operating station "A" clamps the laundry article 10, which is to be fed to the ironing machine, in the two grippers 23,24 by the corners of its front edge (FIGS. 1 and 3). Directly thereafter the operator operates one of the switches 51–53, taking into account the nature of the laundry article 10 determined while clamping the article in the grippers. If at that time all other prerequisites, which are known per se, for the tensioning and centering of the laundry article 10 have been met, the carriage 25 carrying the front gripper 23 is moved in the direction of the arrow 39 by the geared motor 15 with the aid of the chain drive 47 and the rope drive 14. The geared motor 15 is then turning at its high speed, although, because of the gentle speed range transition of the motor, the movement of the carriage 25 and front gripper 23 is started smoothly. During the movement of the carriage 25 and front gripper 23 in the direction of the arrow 39 the carriage 26 carrying the rear gripper 24 remains at first in its starting position (FIG. 4) because of its abovedescribed mounting between the forwardly running and rearwardly running strands 36 and 37 respectively, of the rope drive 14. Simultaneously with this operation, the length of the laundry article 10 is determined with the aid of the digital electronic system (not shown), this length being designated "X" in FIG. 6. Determination of this length is completed when the rear carriage 26 carrying the gripper 24, after the tensioning of the laundry article 10, is subjected to towing and in addition likewise moved in the direction of the arrow 39. At that moment the laundry article 10 is for a short time almost completely taut, so that the length "X" of the article can be determined with adequate accuracy. On the basis of this determination of the length, the digital electronic system determines the moment of time for changing the speed of the geared motor 15 from high to low. This moment is slightly before the centering of the laundry article 10 (FIG. 5). This downward speed change has the effect of moving the laundry article 10 at a relatively low speed into the central position (FIG. 6). The central position is reached when the stop 38 fastened to the strand 37 of the rope drive 14, and therefore moving oppositely to the towing movement (arrow 39), comes to bear against the carriage 26 of the rear gripper 24. In this position of the laundry article 10 the geared motor 15 remains switched on, with the torque determined by the operator with the aid of the switches 51–53 and at zero rotational speed, in order to maintain the tensioning of the laundry article 10 until the latter is transferred to the feed conveyor 12. This behaviour of the geared motor 15 is possible because of a special design of this motor.

Figure 2:
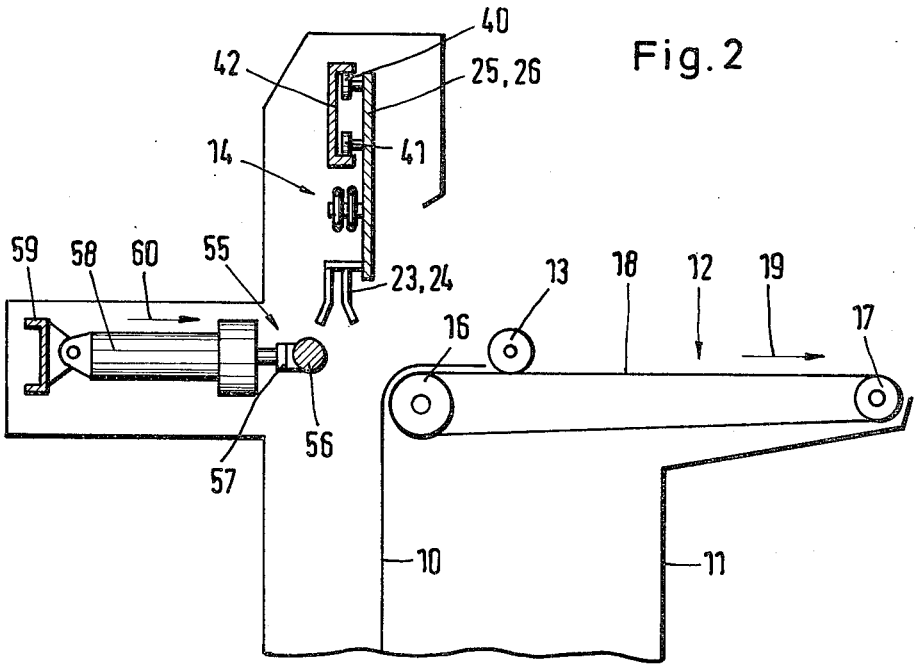
FIG. 2 is a similar section to FIG. 1, but shows a different position of the laundry article.

The transfer of the tensioned and centered laundry article 10 (FIG. 6) to the feed conveyor 12 (FIG. 2) is affected with the aid of the transfer device 55, for which purpose the latter is operatively connected to the gripper drive and control system. The striker rod 56 of the transfer device 55 thus presses the front end of the laundry article 10 onto the loading section of the feed conveyor 12 when the grippers 23,24 open. During this operation the laundry article 10 is held, in a region following its front end, by a holding device which is not shown in the drawings, but which is known per se, in such a manner that it will not drop to the floor through its dead weight. It is held thus until the front end of the laundry article 10 has been advanced under the presser roller 13 resting on the feed conveyor 12 and is thus held immovably by that roller. At the same time the carriages 25 and 26 carrying the respective grippers 23 and 24 are moved back to their starting positions at the operating station "A". The return movement of the carriage 26 together with the rear gripper 24 is effected through the tractive force of the tension spring 43. The carriage 25 together with the front gripper 23 is moved back to its starting position through a change in the direction of rotation of the geared motor 15, the speed of the latter being at the same time increased (high speed), the return speed however being reduced again before the starting position is reached (low speed).

Within the scope of the basic principle of the invention some modifications of the gripper drive and control system are possible. Thus, for example, the different torques of the special geared pole-changing motor can also be obtained in a manner known per se by means of resistance combinations or of a suitable electronic system. In addition, it is also possible, although not so advantageous, to replace the special geared motor by a normal pole-changing geared motor connected to slipping clutches in order to obtain the different torques.

What is claimed is:

1. Apparatus for feeding laundry articles to an ironing machine or the like, wherein the laundry articles are suspended on two grippers of a conveyor device disposed transversely in front of and offset in height in relation to a feed conveyor leading to the ironing machine and, starting from an operating station (A) situated at the side of the working width of the feed conveyor, are conveyed by the conveyor device to a position centrally in front of the loading position of the feed conveyor, and wherein the two grippers of the conveyor device are disposed on a rope drive capable of controlled driving and can be moved in such a manner that the leading gripper, in the conveying direction, pulls the rear gripper in tow behind it via the laundry article, while at the same time pulling the latter taut, characterised in that the drive device used for the rope drive (14) is a geared polechanging motor (15) having two speeds and a smooth speed range transition, that the towing conveying of the laundry article (10) begins when the geared motor (15) is smoothly changed up to the high speed, that switch means (51, 52, 53) changes the geared motor (15) down to its low speed at a moment of time in the course of the towing conveying, and that after the complete tensioning and centering of the laundry article (10), which are effected at low speed, the geared motor (15) remains switched on at a predetermined torque adjusted to the transioning or tautening force acceptable for the laundry article (10) and at zero rotational speed, for the purpose of maintaining the tensioning, until the laundry article is transferred to a feed conveyor (12).

2. Apparatus according to claim 1, characterised in that the geared motor (15) can be adjusted to different torque effective after the centering of the laundry article by applying different voltages.

3. Apparatus according to claim 2, characterised in that these voltages are applied by operating switches (51–53) disposed in the operating station (A).

4. Apparatus according to claim 1, characterised in that a digital electronic system (71) determines the moment of time when the speed of the geared motor (15) is changed down as a function of the length (X) of the laundry article (10).

5. Apparatus according to claim 1, characterised in that the digital electronic system works with a pulse generator (72) for the production of a counting frequency.

6. Apparatus according to claim 1, characterised in that the centering of the laundry article (10) is effected mechanically by means of a stop (38) which is disposed on the rope drive (14), is moved oppositely to the direction of the towing movement, and runs against the rear towed gripper (24).

7. Apparatus according to claim 6, characterised in that the rear gripper (24) is mounted by means of guide rollers (27–32) between the forwardly moving strand (36) and the rearwardly moving strand (37) of the rope drive (14) in such a manner as not to be driven by friction.

8. Apparatus according to claim 6, characterised in that the rear gripper (24) is mounted by means of guide rollers (27–32) between the forwardly moving strand (36) and the rearwardly moving strand (37) of the rope drive (14) in such a manner as to be driven slightly backwards by friction in relation to the direction of towing.

9. Apparatus according to claim 7 or 8, characterised in that the rear gripper (24) and the guide rollers (27–32) are disposed on a carriage (26) which is mounted by means of runners (40, 41) for movement in a guide rail (42).

10. Apparatus according to claim 1, characterised in that there is provided means which, after transfer of the laundry article (10) to the feed conveyor (12), moves the front gripper (23) back to its starting position at high speed by reversing the direction of rotation of the geared motor (15).

11. Apparatus according to claim 10, characterised in that there is provided means which, before the front gripper (23) reaches its starting position, changes the geared motor (15) down to its low speed as a function of time or distance.

12. Apparatus according to claim 1, characterised in that spring means, after transfer of the laundry article (10) to the feed conveyor (12), moves the rear gripper (24) back to its starting position.

* * * * *